United States Patent [19]

Nishimura

[11] 4,309,701

[45] Jan. 5, 1982

[54] LSI DEVICE INCLUDING A LIQUID CRYSTAL DISPLAY DRIVE

[75] Inventor: Toshio Nishimura, Jyoyo, Japan

[73] Assignee: Sharp Kabushiki Kaisha, Osaka, Japan

[21] Appl. No.: 40,173

[22] Filed: May 18, 1979

[30] Foreign Application Priority Data

May 18, 1978 [JP] Japan ..... 53-59554

[51] Int. Cl.[3] ..... G09G 3/36; G04C 10/00; G09F 9/35; G04G 9/04

[52] U.S. Cl. ..... 340/784; 307/296 R; 307/470; 307/474; 340/333; 340/377; 340/803; 340/811; 368/68; 368/84; 368/204; 368/219

[58] Field of Search ..... 307/270, 217, 209, 296 R; 340/333, 377, 765, 784, 803, 811; 350/332; 368/68, 84, 203, 204, 219, 239, 240, 242

[56] References Cited

U.S. PATENT DOCUMENTS

| | | | |
|---|---|---|---|
| 3,903,518 | 9/1975 | Hatsukano | 340/784 |
| 3,936,676 | 2/1976 | Fujita | 307/296 X |
| 4,038,564 | 7/1977 | Hakata | 307/270 X |
| 4,050,064 | 9/1977 | Hashimoto et al. | 340/784 X |
| 4,099,073 | 7/1978 | Hashimoto et al. | 340/811 X |
| 4,158,786 | 6/1979 | Hirasawa | 307/296 R |
| 4,168,498 | 9/1979 | Kubota et al. | 307/296 R X |
| 4,191,955 | 3/1980 | Robert | 340/765 X |

*Primary Examiner*—Larry N. Anagnos

*Attorney, Agent, or Firm*—Birch, Stewart, Kolasch and Birch

[57] ABSTRACT

A power consumption reduction device in an LSI device is disclosed which includes a liquid crystal display drive circuit. The liquid crystal enabling voltage generator including bleeder resistors and adapted for generating three voltage levels is provided with means for shutting down current paths via the bleeder resistors.

3 Claims, 8 Drawing Figures

FIG. 1
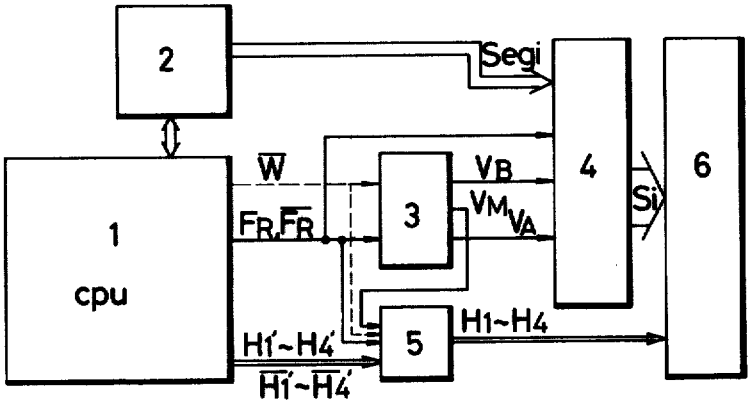
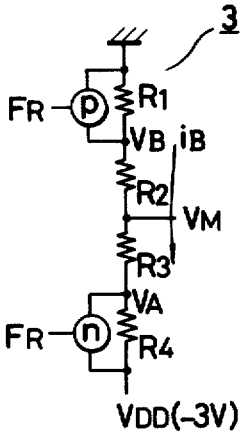
FIG. 2
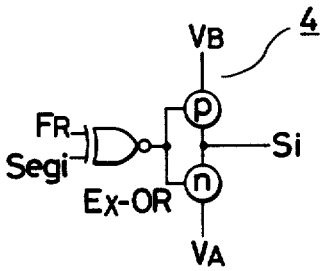
FIG. 3

LSI DEVICE INCLUDING A LIQUID CRYSTAL DISPLAY DRIVE

BACKGROUND OF THE INVENTION

This invention relates to an LSI (large scale integrated circuit) device including a circuit means for reducing power consumption in driving a liquid crystal display.

An effective power supply circuit suitable for supplying a liquid crystal drive circuit with desired voltage levels or potentials has been proposed as disclosed and illustrated in an earlier U.S. Pat. No. 4,050,064, entitled FOUR-LEVEL VOLTAGE SUPPLY FOR LIQUID CRYSTAL DISPLAY, assigned to the same assignee as the present invention. However, for liquid crystal display clock used with the above referenced circuit would consume an appreciable amount of power energy even at midnight when there is little or no possibility that the operator may watch a display on a liquid crystal display panel.

SUMMARY OF THE INVENTION

It is therefore an object of the present invention to provide a power consumption reduction device in an LSI device including a liquid crystal display drive circuit. According to the essential features of the present invention, a liquid crystal enabling voltage generator including bleeder resistors and adapted for generating three voltage levels is provided with means for shutting down current paths via the bleeder resistors.

BRIEF DESCRIPTION OF THE DRAWINGS

For a more complete understanding of the present invention and for further objects and advantages thereof, reference is now made to the following description taken in conjunction with the accompanying drawings, in which:

FIG. 1 is a schematic diagram of an LSI device;

FIG. 2 is a detailed circuit diagram of a liquid crystal enable voltage generator;

FIG. 3 is a logic circuit diagram of a segment electrode selection signal generator;

DETAILED DESCRIPTION OF THE INVENTION

Figure 4:
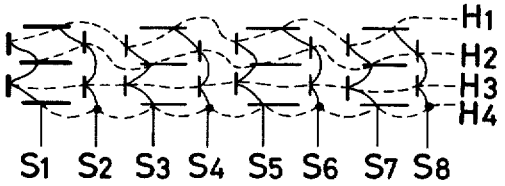
FIG. 4 is a schematic representation of a liquid crystal display panel.

Referring now to FIG. 1, there is illustrated a schematic representation of an LSI device which comprises a central processor unit 1, a display data storage circuit 2, a liquid crystal enable voltage generator 3, a segment electrode selection signal generator 4, a counter electrode selection signal generator 5 and a liquid crystal display panel 6.

FIG. 2 shows a specific example of the liquid crystal enable voltage generator 3. In response to a signal $F_R$ from the central processor unit 1, a p-channel MOS switching circuit generally denoted as Ⓟ or an n-channel MOS switching circuit generally denoted as ⓝ is switched so that voltage waveforms $V_B$, $V_M$ and $V_A$ are developed from junctions between bleeder resistors $R_1$–$R_4$. Assuming that all the resistors $R_1$–$R_4$ are identical in resistance and a power supply voltage $V_{DD}$ is −3 V, the respective voltage waveforms $V_B$, $V_M$ and $V_A$ developed in response to the signal $F_R$ will be tabulated in Table 1.

TABLE 1

| $F_R$ | $V_B$(V) | $V_M$(V) | $V_A$(V) |
|---|---|---|---|
| "L" level | 0 | −1 | −2 |
| "H" level | −1 | −2 | −3 |

FIG. 3 depicts a specific example of the segment electrode selection signal generator 4 adapted for only one segment electrode. For a liquid crystal display panel shown in FIG. 4, eight of the generators are provided in parallel. $V_A$ and $V_B$ are supplied from the liquid crystal enable voltage generator 3 and applied to source terminals of the p- and n-channel MOS transistor inverters Ⓟ and ⓝ. An exclusive OR gate Ex-OR receives the signal $F_R$ and a segment selection signal Segi for the purpose of controlling the above described inverters. The exclusive OR gate develops the following voltage segment waveforms Si as indicated in Table 2, according to the signals $F_R$ ane Segi.

TABLE 2

| $F_R$ | Segi | Si(V) |
|---|---|---|
| "L" level | "L" level | −2 (=$V_A$) |
| "L" level | "H" level | 0 (=$V_B$) |
| "H" level | "L" level | −1 (=$V_B$) |
| "H" level | "H" level | −3 (=$V_A$) |

Figure 5:
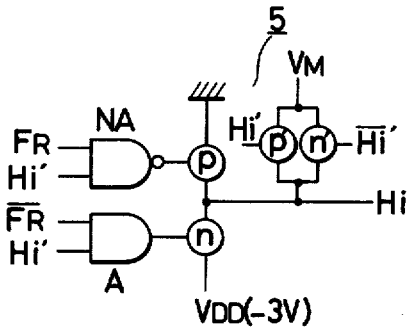
FIG. 5 is a logic circuit diagram of a counter electrode selection signal generator.

In FIG. 5, there is illustrated a specific example of the counter electrode waveform generator 5 for only one counter electrode. The liquid crystal display panel shown in FIG. 4 requires the four waveform generators 5. A signal Hi' and its reversal $\overline{Hi'}$ are supplied from the central processor unit 1 and transferred into the respective generator circuits at different points in time. $\overline{F_R}$ is the reversal of the signal $F_R$ supplied from the central processor unit 1 and enables the p-channel MOS switching circuit Ⓟ and the n-channel MOS switching circuit ⓝ to change their position in reply to the outputs of a NAND gate NA receiving the signals $F_R$ and Hi' and an AND gate A receiving the signals $\overline{F_R}$ and Hi', respectively. These switching circuits are connected in series between the ground and the power supply voltage $V_{DD}$(−3 V), the junction thereof being further connected to a transmission gate consisting of p-channel and n-channel MOS transistors Ⓟ and ⓝ responsive to the signals Hi and $\overline{Hi}$ and being supplied with the voltage waveform $V_M$. A voltage waveform Hi is developed at the junction for a specific counter electrode. The voltage waveform Hi varies as a function of the signals $F_R$ and Hi' is summarized as follows:

TABLE 3

| $F_R$ | Hi | Hi(V) |
|---|---|---|
| "L" level | "L" level | −1 (=$V_M$) |
| "L" level | "H" level | −3 (=$V_{DD}$) |
| "H" level | "L" level | −2 (=$V_M$) |
| "H" level | "H" level | 0 (=ground) |

Figure 6:
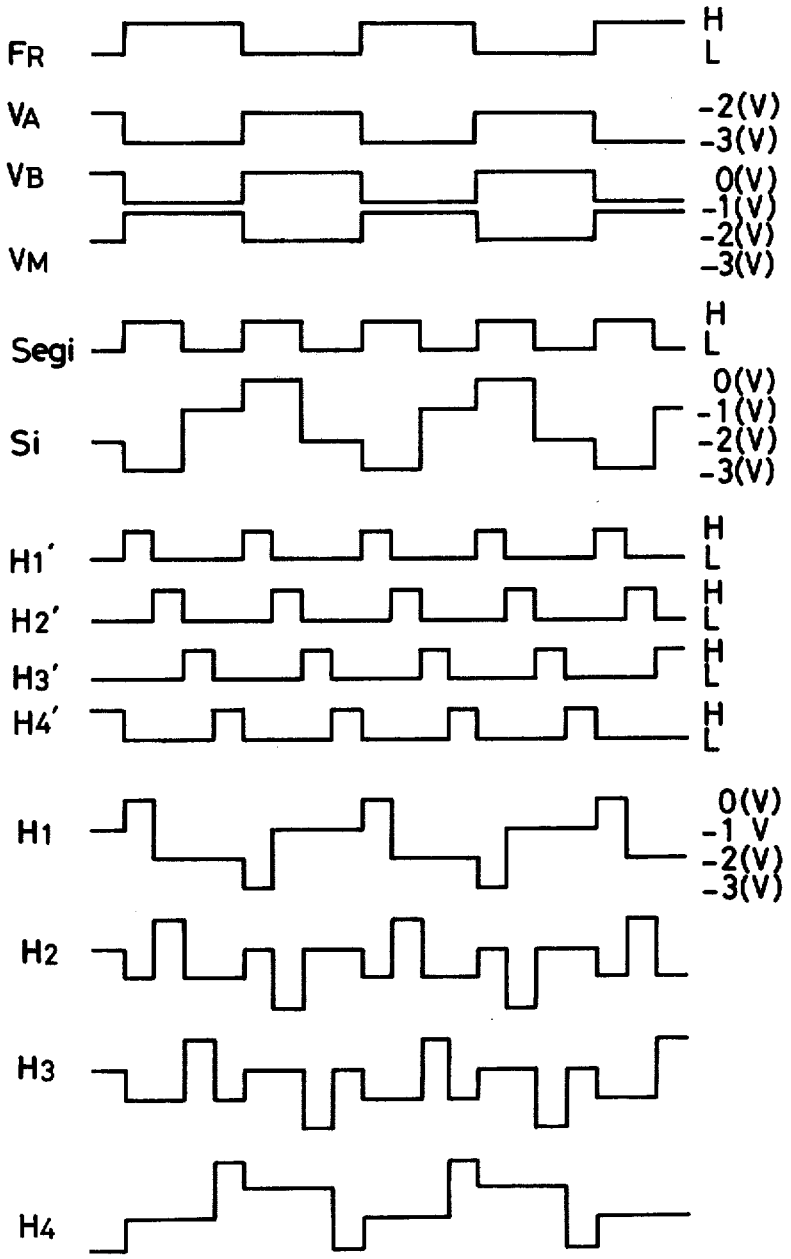
FIG. 6 is a time chart for explanation of operation of the liquid crystal enable voltage generator.

The above described events in operation are depicted in a flow chart of FIG. 6. The liquid crystal display panel 6 of FIG. 1 is driven with a $\frac{1}{4}$ duty factor and a $\frac{1}{3}$ bias. The waveform Segi in the flow chart is only illustrative and other forms thereof are easily available. In the illustrated example, the intersections with the segment electrode $S_1$ and the counter electrodes $H_1$ and $H_2$ is enabled in an "ON" stage.

As suggested in our earlier patent, a bleeder resistor circuit of FIG. 2 is provided to supply current $i_B$ at all times to obtain the liquid crystal enable voltages $V_A$, $V_B$ and $V_M$. As the power requirement for LSI devices is reduced progressively, consumption current due to the current $i_B$ occupies an increasing proportion of an overall consumption current, failing to reduce a power consumption to a minimum.

Figure 7:
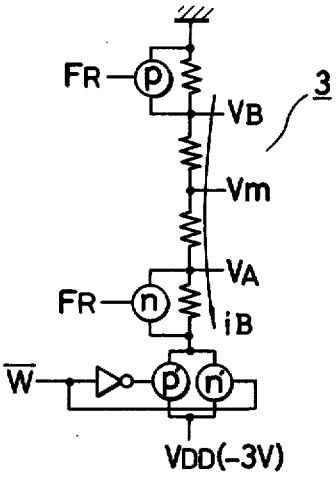
FIG. 7 is a detailed circuit diagram of a liquid crystal display enable voltage generator according to one preferred form of the present invention.

Keeping in mind the fact that there is little or no possibility that the operator may watch a liquid crystal clock, for example, during the night, the present invention enables the current path via the bleeder resistors to be shut down upon the development of a particular signal W from the central processor unit 1, thus realizing a reduction in power consumption by the amount corresponding to the current flowing in the bleeder resistors. FIG. 7 shows an example of the liquid crystal enable voltage generator 3 made in accordance with the concept of the present invention. A transmission gate consisting of p-channel and n-channel MOS transistor Ⓟ ' and ⓝ ' is interposed between the bleeder resistor circuit and a power supply voltage $V_{DD}$ terminal. In the case where the signal $\overline{W}$ is at an "L" level, both the MOS transistors are turned off to shut down the current path via the bleeder resistors. When this occurs, the voltage waveforms $V_B$, $V_M$ and $V_A$ are pulled to the ground side and thus at OV (ground potential). The segment waveform Si developed from the segment waveform generator 4 of FIG. 3 is therefore normally at OV.

Figure 8:
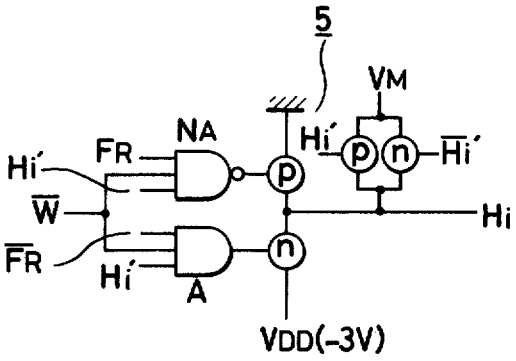
FIG. 8 is a logic circuit diagram of a counter electrode selection signal generator according to one preferred form of the present invention.

In the case where the current path via the bleeder resistors is shut down in the liquid crystal enable voltage generator 3 in this manner, the ground potential and the power supply voltage $V_{DD}(-3\ V)$ will be developed in the voltage waveform applied to the counter electrode Hi thereby driving inadvertently the liquid crystal display as far as the counter electrode waveform generator 5 remains unchanged as in FIG. 5. This event happens irrespective of whether the segment selection signal Segi is supplied from the display data storage circuit 2 and results in undesirable power consumption. FIG. 8 shows a specific example of the counter electrode waveform generator 5 in combination with the improved liquid crystal enable voltage generator 3 shown in FIG. 7. In FIG. 8, the signal W is applied to the NAND gate NA and the AND gate A. When the signal $\overline{W}$ is at a "L" level, the p-channel and n-channel MOS switching circuits are in the OFF state irrespective of the logic conditions of the signals $F_R$ and Hi' so that the voltage waveform developing at the counter electrode Hi is free of the ground potential and the power supply voltage $V_{DD}$. The remaining voltage waveform $V_M$ supplied from the transmission gate is urged at OV due to the shutdown of the current path in the bleeder resistor circuit. The voltage waveform at the counter electrode Hi assumes OV as a whole so that the liquid crystal display 6 is never driven.

It is also obvious that in the circuit of FIG. 8 the voltage waveform Hi developed by the MOS switching circuit may be placed at the ground potential (OV). In addition, a transmission gate may be interposed between the n-channel MOS switching circuit or the p-channel MOS switching circuit and the power supply voltage $V_{DD}$ terminal such that the gate is pulled to the ground potential when the signal W is at a "L" level. Within the liquid crystal enable voltage generator 3 of FIG. 7, it is possible to insert the transmission gate at the ground side such that the voltage waveforms $V_A$, $V_M$ and $V_B$ are always at $-3$ V to shut down the current path when the signal $\overline{W}$ is at an "L" level. In the case the transmission gate, etc. is inserted within the counter electrode waveform generator 5 as stated above, it may be inserted on the ground side.

As indicated by the dotted line in FIG. 1, the signal $\overline{W}$ may render the above described power consumption reduction circuit operative at night and inoperative in morning while monitoring the contents of a clock. In the case of electronic calculators, the power consumption reduction circuit may become operative after a predetermined period of time from the absence of any key actuation.

As noted earlier, according to the present invention, the liquid crystal enable voltage generator having bleeder resistors for generating three voltage levels is provided with means for shutting down the current path and thus preventing current from flowing through the bleeder resistors and reducing power consumption. In shutting down the current path the three voltage levels are placed at the same level. The voltage waveform applied to the counter electrode is made equal to at least the three voltage levels within the counter electrode voltage waveform generator. Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. In a circuit for driving a liquid crystal display, said liquid crystal display including segment electrodes and a counter electrode, said circuit including a segment electrode selection signal generator for driving selected ones of said segment electrodes of said liquid crystal display, a liquid crystal enable voltage generator for developing a plurality of voltages to drive said segment electrode selection signal generator and for developing a further output signal, a counter electrode selection signal generator responsive to said further output signal for developing a voltage waveform and applying said voltage waveform to said counter electrode, and control means for developing a control signal and for developing driving signals for driving said liquid crystal enable voltage generator and said counter electrode selection signal generator, the improvement comprising:

a plurality of bleeder resistors for generating said plurality of voltages from said enable voltage generator;

open-circuiting means responsive to said control signal from said control means and connected in series with said bleeder resistors for open-circuiting a current path through said bleeder resistors and for constraining the plurality of voltages to a substantially identical level; and clamping means responsive to said control signal from said control means for containing the voltage waveform being applied to said counter electrode by said counter electrode selection signal generation to a voltage which is substantially equal to said substantially identical level.

2. A circuit in accordance with claim 1, wherein said clamping means comprises:

gate means responsive to said control signal from said control means and to said driving signals from said control means for developing output signals in response thereto;

first transistor means connected between a ground potential and a power supply and responsive to said output signals from said gate means for developing said voltage waveform to drive said counter electrode; and second transistor means connected at one terminal to the output of said first transistor means, a current flowing through said bleeder resistors producing said further output signal, said further output signal being applied to another terminal of said second transistor means.

3. A circuit in accordance with claim 2, wherein said further output signal produced by said bleeder resistors is reduced in value in response to the open-circuiting of said current path through said bleeder resistors;

said gate means renders said first transistor means non-conductive in response to said control signal from said control means thereby disconnecting the output of said first transistor means from said ground potential and from said power supply; and the reduced value of said further output signal produced by said bleeder resistors is supplied to said another terminal of said second transistor means;

whereby near-zero value voltage is applied to said counter electrode of said liquid crystal display in response to said control signal from said control means.

* * * * *